US006203243B1

(12) United States Patent
Birtchet

(10) Patent No.: US 6,203,243 B1
(45) Date of Patent: Mar. 20, 2001

(54) TWO-STAGE PAVING SCREED EXTENSION

(75) Inventor: Ralph D. Birtchet, deceased, late of Centralia, WA (US), by Delores L. Birtchet, executor

(73) Assignee: Universal Screed Inc., Centrailia, WA (US)

( * ) Notice: Subject to any disclaimer, the term of this patent is extended or adjusted under 35 U.S.C. 154(b) by 0 days.

(21) Appl. No.: 09/017,815

(22) Filed: Feb. 3, 1998

(51) Int. Cl.[7] ..... E01C 19/22
(52) U.S. Cl. ..... 404/104; 404/118; 404/119
(58) Field of Search ..... 404/83, 90, 101, 404/104, 118, 119

(56) References Cited

U.S. PATENT DOCUMENTS

| | | | | |
|---|---|---|---|---|
| 3,236,163 | | 2/1966 | Ackerman et al. . | |
| 3,415,173 | * | 12/1968 | Paul | 404/118 |
| 3,700,288 | | 10/1972 | Davin et al. . | |
| 3,702,578 | | 11/1972 | Davin . | |
| 3,776,326 | | 12/1973 | Davin et al. . | |
| 3,992,124 | * | 11/1976 | Schrader | 404/118 |
| 4,345,852 | * | 8/1982 | Goto et al. | 404/114 |
| 4,379,653 | | 4/1983 | Brown . | |
| 4,808,026 | * | 2/1989 | Clarke, Jr. et al. | 404/90 |
| 5,203,642 | * | 4/1993 | Heller et al. | 404/118 |
| 5,222,829 | * | 6/1993 | Mogler et al. | 404/118 |
| 5,344,254 | | 9/1994 | Sartain . | |
| 5,417,516 | | 5/1995 | Birtchet . | |
| 5,443,325 | | 8/1995 | Simonelli et al. . | |
| 5,702,202 | * | 12/1997 | Schleiter | 404/118 |
| 5,725,325 | * | 3/1998 | Schleiter et al. | 404/118 |

OTHER PUBLICATIONS

Caterpillar Tractor Co., "No One Has More Ways to Produce, Pave, Compact and Profile Asphalt Than Caterpillar," product flyer, six pages.
Cedarapids Inc., "Cedarapids Grayhound Hot Mix Pavers, Performance and reliability never looked so good," Bulletin PGC–3, (Mar. 1995), 10 pages.

* cited by examiner

*Primary Examiner*—Eileen D. Lillis
*Assistant Examiner*—Gary S. Hartmann
(74) *Attorney, Agent, or Firm*—Christensen O'Connor Johnson Kindness PLLC

(57) ABSTRACT

An extension screed assembly (18) for use with a paving machine (14) having a main screed (12) includes a first sliding back board (20), a first linear actuator (22) coupled to the main screed and the first sliding back board, a first extension screed (30), and a second linear actuator (32) coupled to the first sliding back board and the first extension screed. The first linear actuator displaces the first sliding back board relative to the main screed along the length of the main screed. The second linear actuator displaces the first extension screed relative to the first sliding back board along the length of the main screed. When two extension screeds are provided, one on each side of the main screed, and are fully extended, an effective paving width of the main screed doubles.

15 Claims, 10 Drawing Sheets

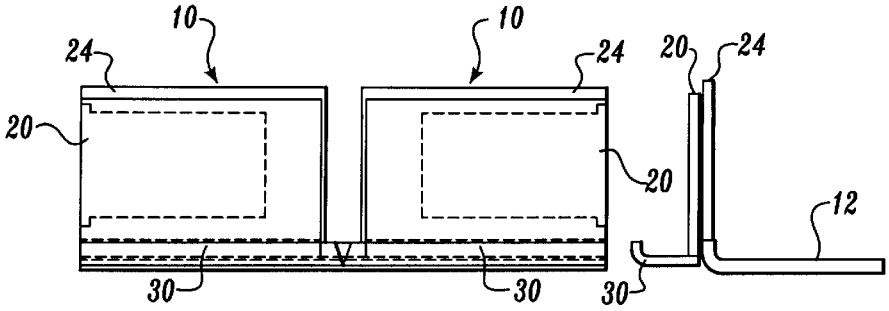
Fig. 12A.
Fig. 12E.
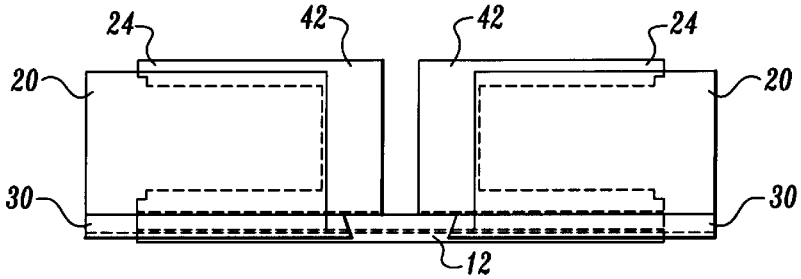
Fig. 12B.
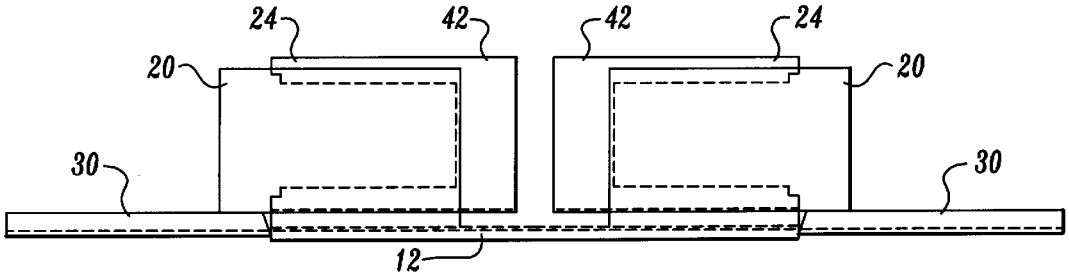
Fig. 12C.
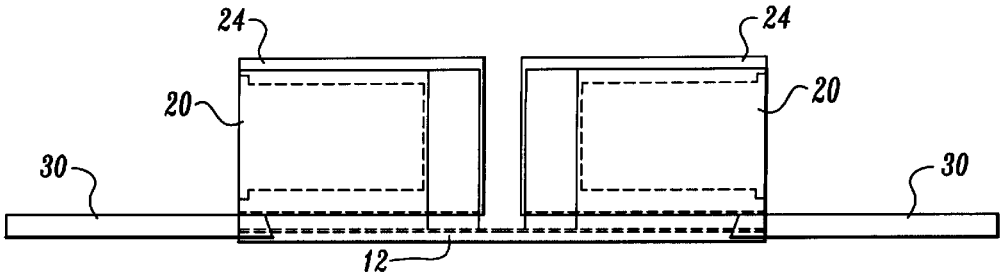
Fig. 12D.

TWO-STAGE PAVING SCREED EXTENSION

FIELD OF THE INVENTION

The present invention relates to asphalt paving equipment, and more particularly to an extension screed assembly used in variable-width paving.

BACKGROUND OF THE INVENTION

The laying of asphalt paving material on road surfaces entails spreading an aggregate-filled tar-based paving material on a prepared roadbed. The paving material is spread while hot and is then compacted so that, upon cooling, a hard pavement surface is formed. Conventional paving machines utilize a heavy metal plate termed a "screed," usually constructed of steel or iron, to compact the paving material. The screed is typically mounted on pivot arms at the rear end of the paving machine. The weight of the screed, as well as other structures carried on the screed, acts to compress and tamp the paving material into a compact layer.

To pave road surfaces of variable width, the screeds width must be adjusted, typically between 8 feet and 20 feet. Conventional adjustable-width screeds include an elongate main screed and a set of hydraulically powered extension screeds that extend outwardly along the length of the main screed. Extension screeds may be mounted on either a front side or a rear side of the main screed. The term "front" refers to the side that is closest in proximity to a paving machine's main body and "rear" refers to the opposite direction. When extended, front-mounted extension screeds lie in front of the main screed, while rear-mounted extension screeds lie behind the main screed.

Front-mounted extension screeds are generally preferable over rear-mounted extension screeds. For example, front-mounted extension screeds effectively collect excess asphalt mix and push it to a forward side of a main screed. This allows the extension screed end gates to pull all of the excess asphalt mix into the front of the main screed when completing variable-width paving. On the other hand, when rearmounted extensions are retracted, excess asphalt is trapped between the extension screed end gate and the main screed body. Thus, extra manual labor is required to dispose of the excess mix to allow the extension screed to close.

The front-mounted screed has a much smaller surface area where the loose asphalt collects prior to going under the screed in the paving process. This is apparent in that all mix is contained in front of the paving screed whereas with a rearmounted screed the mix must fully pass by the main paving screed before reaching its containment area in front of the extension screeds.

Legislation has been passed into law as of Jan. 1, 1998 through an agreement between the federal government and the paving industry manufacturers that dictates that all tramp fumes escaping from unpaved loose asphalt mix must be collected and removed from the immediate work area of the paving laborers and operators.

As the front-mounted screed has a much smaller surface area for the collection system to work on, it is more ideally located between the main screed and the paving tractor to meet these laws. Despite the apparent advantages, use of front-mounted extension screeds has been limited in the past due to configurational limitations on the maximum extension width achievable. Extension screeds, components, and housings must maintain some separation at the center of the screed to allow for variable positive or negative crown commonly used in the paving process.

Typically, asphalt is waterproof and is placed on a horizontal slope to direct the flow of water. Horizontal slope is produced by bending the main screed plate equally from front to back at the center of the screed to create a high or low point in the screed bottom that will reflect through to the asphalt surface laid. This bending force is applied simultaneously to the front and back of the screed plate by power crown equipment that is located on the top of the screed deck at the center of the main screed.

The physical space occupied by the power crown equipment and the clearances required to allow for the bending effect of the operation of the power crown are a considerable limiting factor in wider extension screed assembly options.

Specifically, in order to be front mounted, two extension screeds, one on each side of a main screed, must be aligned with each other along the length of the main screed because of the limited space between a paving machine's main body and the main screed. In this aligned configuration, the effective extension width of each of the extension screeds becomes less than one half of the main screed length, typically about one foot short of the half length. As a result, to date, no commercially available front-mounted screed extension assembly has enabled the hydraulically actuated doubling of the effective paving width of a main screed.

Accordingly, a need exists for a front-mounted screed assembly that can automatically double an effective paving width of a main screed. Horizontal grade breaks are also created at the intersection point of the main screed and the extension screed by placing a different horizontal slope on the extension screed than the main screed. The need has become even greater in light of a recently issued U.S. Department of Transportation guideline that requires a five-foot shoulder to be paved integrally with one travel lane surface while having both surfaces on different slopes.

SUMMARY OF THE INVENTION

The present invention provides a screed assembly for use with a paving machine, that includes an elongate main screed assembly, a first sliding back board, and a first linear actuator that is coupled to both the main screed and the first sliding back board. The first linear actuator displaces the first sliding back board relative to the main screed along the length of the main screed. The invention further includes a first extension screed, and a second linear actuator that is coupled to both the first sliding back board and the first extension screed. The second linear actuator displaces the first extension screed relative to the first sliding back board along the length of the main screed.

In a further aspect of the present invention, a second extension screed assembly as described above is provided adjacent the first set. When two extension screeds are thus provided and fully extended, the effective paving width of the main screed is doubled hydraulically upon extension of the first and second extension screeds. In a still further aspect of the invention, two extension screed assemblies of the present invention can be mounted in front of a main screed, aligned and parallel to a longitudinal axis of the main screed. Accordingly, the present invention provides front-mounted extension screeds that can hydraulically double the effective paving width of a main screed.

An extension screed assembly for mounting on a conventional main screed of a paving machine is also provided, and includes a first sliding back board, a first linear actuator, a first extension screed, and a second linear actuator, as described above. The extension screed assembly can be readily mounted on a conventional main screed.

Furthermore, a sliding back board assembly for coupling with a conventional main screed and a conventional extension screed assembly is also provided, and includes a sliding back board and a first linear actuator.

The present invention provides several advantages over the conventional extension screed assembly. First, as described above, because two extension screeds are aligned and parallel to the longitudinal axis of a main screed, the assembly occupies only a narrow space, and thus can be mounted on a front side of a main screed. Second, by combining a sliding back board and an extension screed, the present invention doubles the effective paving width of the main screed. The invention also provides an extension screed assembly and a sliding back board assembly that can be combined with a conventional main screed and a conventional extension screed assembly, to achieve the front-mounted double-width paving screed of the present invention.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein:

FIGS. 12A through 12D are schematic front views of the screed assembly of FIG. 1 in operation, where 12A shows the screed assembly closed, 12B shows only sliding back boards fully extended, 12C shows both sliding back boards and extension screeds fully extended, and 12D shows sliding back boards closed and only extension screeds fully extended;

FIG. 12E is a schematic end view of the screed assembly of FIGS. 12A through 12D.

DETAILED DESCRIPTION OF THE PREFERRED EMBODIMENT

Figure 1:
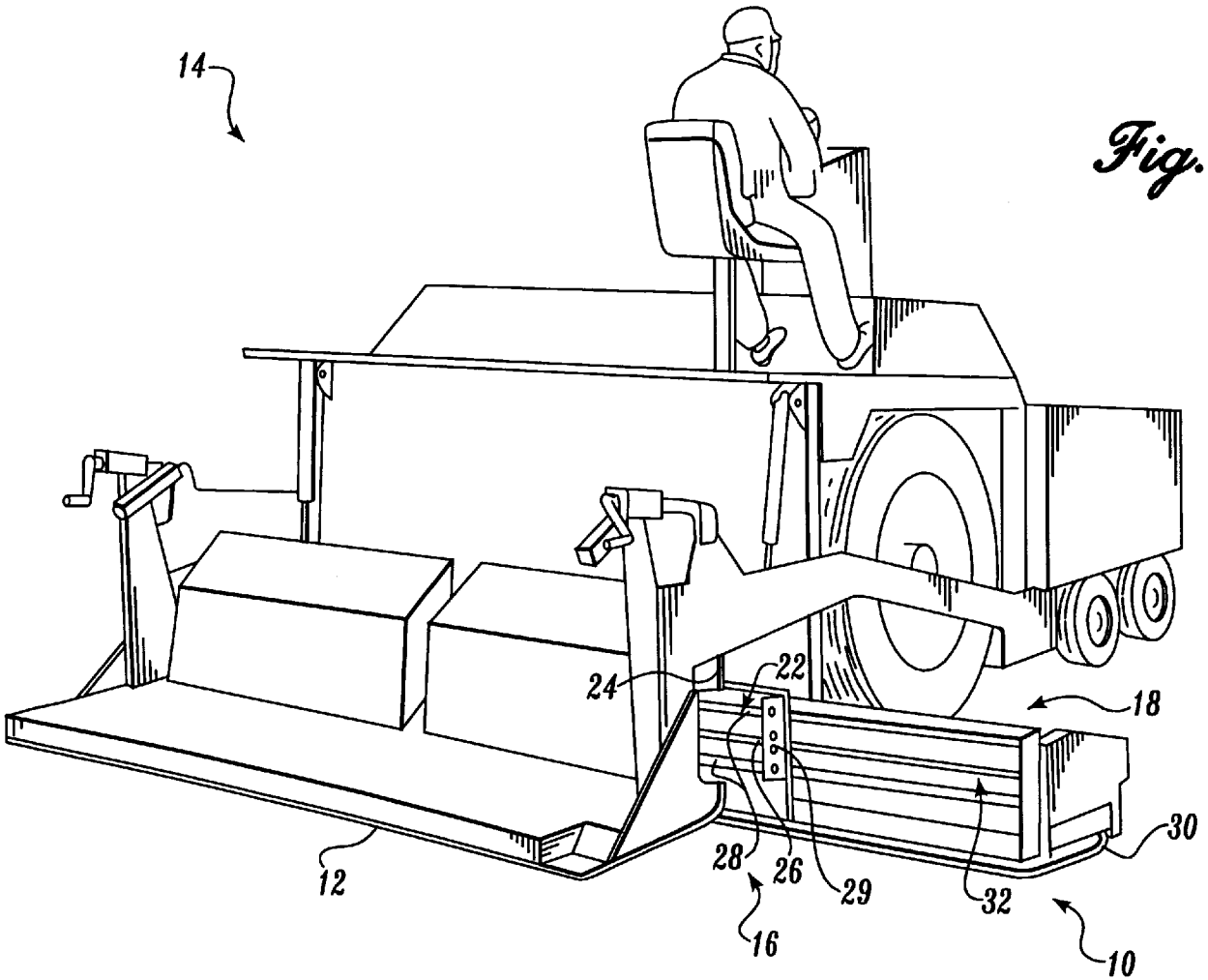
FIG. 1 provides a pictorial view of an extension screed assembly in accordance with the present invention mounted on a front side of a main screed of a paving machine.

A screed assembly 10 constructed in accordance with the present invention is shown mounted on a front side of an elongate main screed 12 of a paving machine 14 in FIG. 1. Throughout this application, the term "front" refers to the side that is closest in proximity to a paving machine's main body and "rear" or "behind" refers to the opposite direction. The screed assembly 10 includes an extension screed assembly 18 that further includes a sliding back board assembly 16. The sliding back board assembly 16 includes a sliding back board 20 and a first linear actuator 22 that is coupled to a mold board 24 of the main screed 12. The first linear actuator 22 suitably is formed from a hydraulic cylinder assembly 26, a pair of support shafts 28, and an end plate 29, and displaces the sliding back board 20 relative to the main screed 12 along the length of the main screed 12. The extension screed assembly 18 further includes an extension screed 30 and a second linear actuator 32 that is coupled to the sliding back board 20. The extension screed 30 and the second linear actuator 32 are carried on the sliding back board 20, and thus move laterally thereon along the length of the main screed 12. The second linear actuator 32 also suitably is formed from a hydraulic cylinder and support shafts, and displaces the extension screed 30 relative to the sliding back board 20 along the length of the main screed 12. The first linear actuator 22 coupled to the sliding back board 20, when not extended, is housed in a housing box, to be described subsequently, that includes the mold board 24. Though the following description focuses on one extension screed assembly 18 as described above, it is to be understood that a second extension screed assembly that is configured as a mirror image of the first extension screed assembly 18 is suitably mounted adjacent the first extension screed assembly 18 along the length of the main screed 12. The second extension screed assembly is preferably included and aligned longitudinally next to the first extension screed assembly 18, to extend in the opposite direction thereof Thus, the following description of the first extension screed assembly 18 should be understood to apply as well to the second extension screed assembly.

Figure 2A:
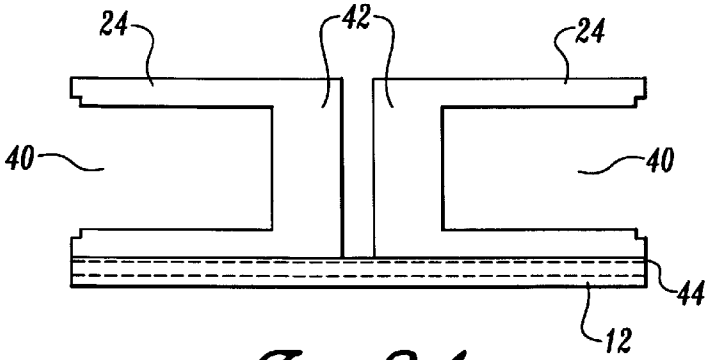
FIGS. 2A, 2B, and 2C are a front view, an end view, and a top plan view, respectively, of mold boards of the main screed of FIG. 1.
Figure 2B:
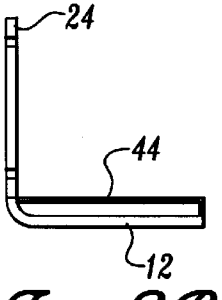
Figure 2C:
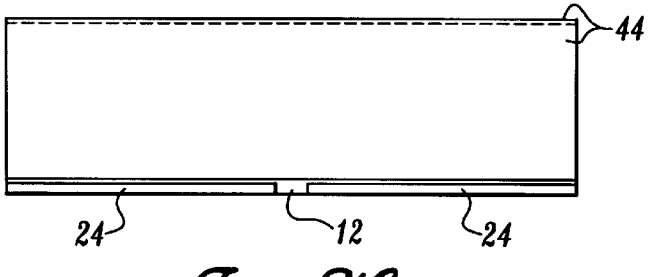

FIGS. 2A, 2B, and 2C are a front view, an end view, and a top plan view, respectively, of first and second mold boards 24 on which the first extension screed assembly and second extension screed assembly are mounted, respectively. Each of the mold boards 24 is provided with a generally laterally extending U shape, and includes a rectilinear opening 40 bordered by horizontal leg portions and a vertically oriented base portion 42. The base portion 42 is provided for structural integrity, and to prevent asphalt mix from intruding inside a housing box (to be described subsequently) when a sliding back board 20 (not shown) is displaced relative to the mold board 24, as more fully described below. Thus, the width of the base portion 42 along the length of the main screed 12 is to be determined based on a preferred displacement width of a sliding back board. As shown, the two mold boards 24 are positioned to project perpendicularly upward from the main screed 12, and are thus oriented edgewise on a front longitudinal edge of the main screed 12. The first and second mold boards are placed so that the base portions 42 thereof oppose each other around a central point of the longitudinal edge of the main screed 12. A conventional deck plate 44 overlies, and is spaced above, the main screed 12. The mold boards 24 are mounted to the main screed 12 and the deck plate 44 in a conventional manner, such as by welding, riveting or bolting.

Figure 3A:
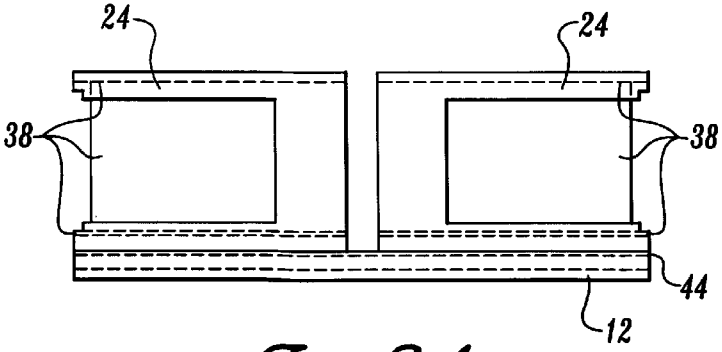
FIGS. 3A, 3B, and 3C are a front view, an end view, and a top plan view, respectively, of housing boxes secured to the mold boards of FIGS. 2A–2C for housing linear actuators in accordance with the present invention.
Figure 3B:
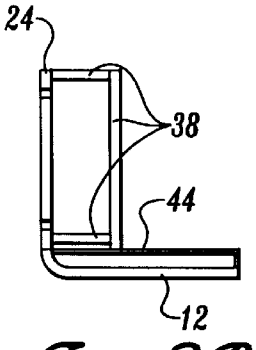
Figure 3C:
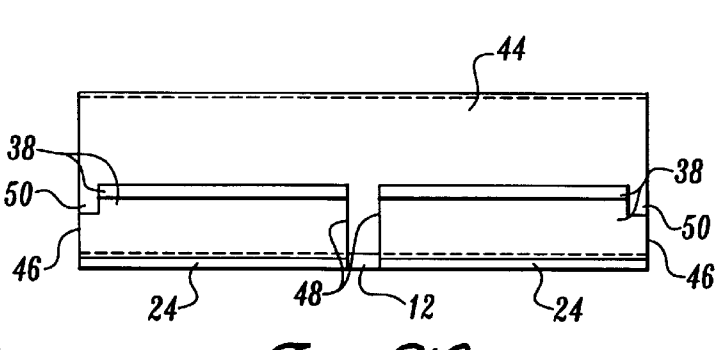

FIGS. 3A, 3B, and 3C are a front view, an end view, and a top plan view, respectively, of the housing boxes 38 mounted to the mold boards 24 to house the linear actuators. The housing boxes 38 are typically made of the same material as the mold boards 24, such as steel. The housing boxes 38 are provided on the deck plate 44 on a rear side of the mold boards 24 so that the mold boards 24 define front surfaces of the housing boxes 38. Each of the housing boxes 38 is provided with an open end 46 and a closed end 48 that oppose each other, and is positioned so that two closed ends 48 face each other around a midpoint of the length of the main screed 12. The housing box 38 is suitably welded to the mold board 24 to form an integral unit. As shown in FIG. 3B, the bottom surface of the housing box 38 is spaced slightly above the deck plate 44. As shown in FIG. 3C, opposite the closed ends 48, cuts 50 that run throughout the height of the housing boxes 38 are provided adjacent the open ends 46 in order to allow space for the pull arms and pivot arms (not shown) through to the deck plate 44.

Figure 4C:
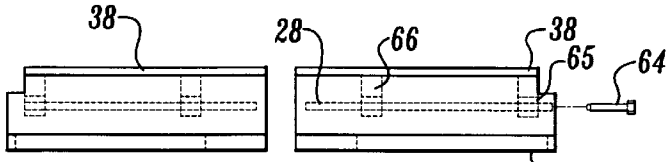
FIGS. 4A, 4B, and 4C are a front view, an end view, and a top plan view, respectively, of first and third linear actuators configured in accordance with the present invention for use in the screed assembly of FIG. 1.
Figure 4B:
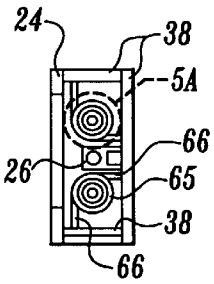
Figure 4A:
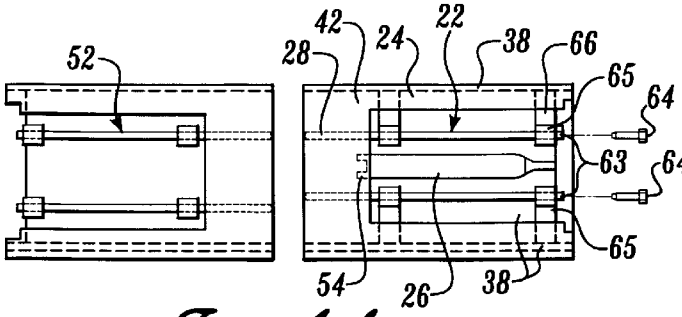

FIGS. 4A, 4B, and 4C are a front view, an end view, and a top plan view, respectively, of the first linear actuator 22 of the first extension screed assembly 18 and a corresponding third linear actuator 52 of the second extension screed assembly. Though FIGS. 4A and 4C are asymmetric, and the following focuses on description of the first linear actuator 22 only, it should be understood that the third linear actuator 52 is a mirror image of the first linear actuator 22.

Inside the housing box 38, now integral with the mold board 24, is housed the first linear actuator 22 comprising a hydraulic cylinder assembly 26 that lies horizontally about halfway above the bottom of the housing box 38. As shown in FIG. 4A, a proximal end 54 of the hydraulic cylinder assembly 26 lies roughly behind the interface between the base portion 42 and the opening 40 of the mold board 24. The proximal end 54 is solidly mounted to the housing box 38, such as by bolting to a welded boss (not shown). As best illustrated in FIG. 9E, the hydraulic cylinder assembly 26 includes a proximal part comprising a hydraulic cylinder 55 and a distal part comprising a hydraulic ram 56. As shown in FIG. 9D, a distal end of the hydraulic ram 56 is forked into two legs 57 to sandwich a hydraulic cylinder attachment plate 58 therebetween. Each of the two legs 57 includes a hydraulic cylinder ram attachment hole 59 FIG. 9E, and the hydraulic cylinder attachment plate 58 also includes a bolt guide hole 60 (see FIG. 8A). These three holes are aligned together, and a cylinder ram attachment bolt and nut assembly 61 (see FIG. 8B) is used to secure the hydraulic ram 56 to the hydraulic cylinder attachment plate 58. The hydraulic cylinder attachment plate 58 is further provided with a pair of threaded apertures 62 (see FIG. 8A) that run perpendicular to the bolt guide hole 60. The threaded apertures 62 are used to secure the hydraulic cylinder assembly 26 to an end plate 29, as more fully described in reference to FIGS. 8A and 8B below.

Referring again to FIGS. 4A, 4B, and 4C, the first linear actuator 22 further includes a pair of support shafts 28 that lie in parallel with the hydraulic cylinder assembly 26, one lying above and the other lying beneath it. The support shafts 28 are of roughly the same length as the horizontal length of the mold board 24. Distal ends of the support shafts 28 include threaded apertures 63 (see also FIG. 5A) that receive bolts 64. The bolts 64 are used to secure the support shafts 28 to an end plate, as more fully described in reference to FIGS. 8A and 8B.

Figure 5B:
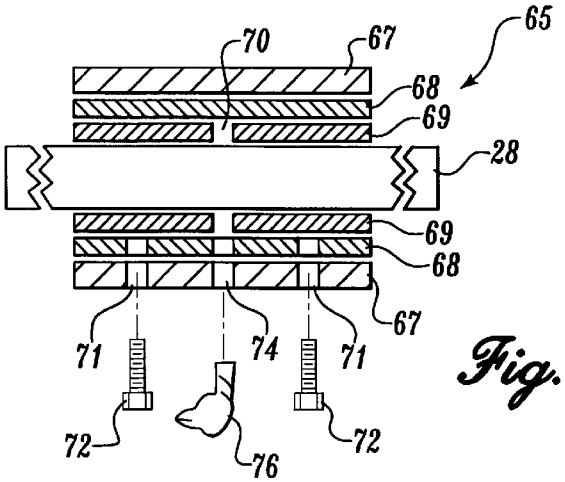
FIGS. 5A and 5B are a detailed schematic end view and a detailed schematic cross-sectional view, respectively, of a support shaft guide of FIGS. 4A and 4B configured in accordance with the present invention.
Figure 5A:
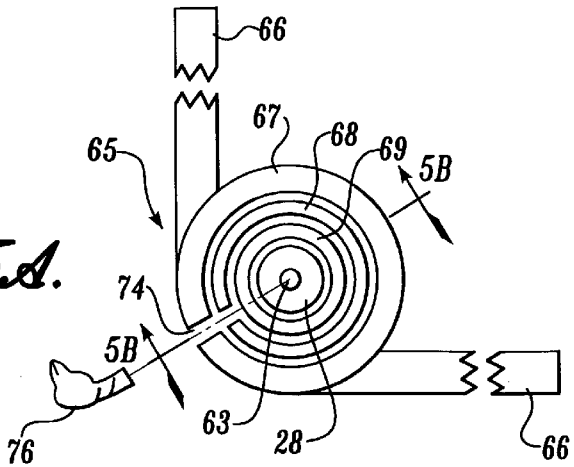

Further referring to FIGS. 4A, 4B, and 4C, each support shaft 28 is guided through two support shaft guides 65, which will be more fully described in reference to FIGS. 5A and 5B. Four support shaft guides 65, two above and two below for each support shaft 28, are welded to the housing box 38 roughly behind four corners of the opening 40 of the mold board 24. As best illustrated in FIG. 4B, the support shaft guides 65 are welded to the housing box 38 with two-legged guide housing attachments 66. With respect to two support shaft guides 65 that are positioned above, one leg of the guide housing attachment 66 is welded to a top surface of the housing box 38, while the other leg is welded to its rear surface. For the other two support shaft guides 65 that are positioned below, one leg of the guide housing attachment 66 is welded to a bottom surface and the other to a rear surface of the housing box 38.

FIGS. 5A and 5B are a detailed schematic end view and a detailed schematic cross-sectional view, respectively, of the support shaft guide 65 as introduced above. The support shaft guide 65 includes a cylindrical guide housing 67 that is welded to the guide housing attachment 66 that is further welded to the housing box 38 as described above. Inside the guide housing 67 is provided a coaxial cylindrical guide boss 68, and inside the guide boss 68 is provided a coaxial bushing 69, such as a brass bushing, formed from two bushing cylinders disposed end-to-end with a central gap therebetween. Preferably, the inner diameter of the bushing 69 closely matches but is slightly greater than the outer diameter of the support shaft 28, so that lubricant can thoroughly spread over the interface between the two members. It should be understood that the guide boss 68 is provided for easy fabrication purposes only. Specifically, as attachment of the guide housing 67 to the housing box 38 with the guide housing attachment 66 preferably entails welding, warping of the guide housing 67 may potentially result during manufacture. The guide boss 68 is provided to compensate for this warping, and to better fit the bushing 69 into the guide housing 67.

As best illustrated in FIG. 5B, the two cylindrical segments of the bushing 69 are coaxially aligned end-to-end, and spaced apart from each other, to form an annular grease channel 70 that completely surrounds the support shaft 28. To secure the bushing 69 in position, two apertures 71 are provided through the guide housing 67 and the guide boss 68 for receiving threaded lock bolts 72. The threaded lock bolts 72 assemble the guide housing 67, the guide boss 68, and the bushing 69 tightly together, without any significant annular gaps therebetween. To supply lubricant to the support shaft 28, a threaded grease passage 74 that communicates with the grease channel 70 is provided through the guide housing 67 and the guide boss 68. A grease nipple 76 is threaded into the radial outer end of the grease passage 74. Lubricant supplied to the grease nipple 76 travels through the grease passage 74 to the annular grease channel 70 that completely surrounds the support shaft 28. From there, lubricant spreads over the entire interface between the support shaft 28 and the bushing 69.

Figure 6A:
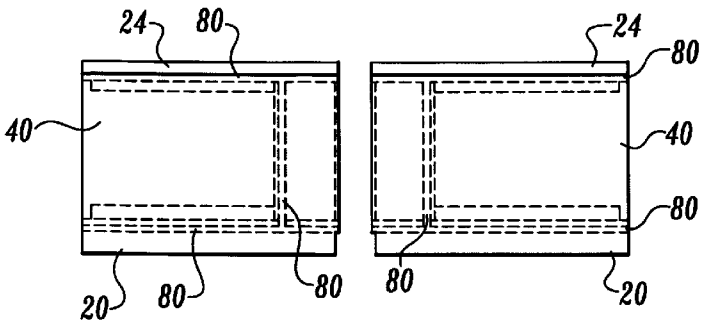
FIGS. 6A, 6B, and 6C are a front view, an end view, and a top plan view, respectively, of the assembly of mold boards and sliding back boards of FIG. 1 in accordance with the present invention.
Figure 6B:
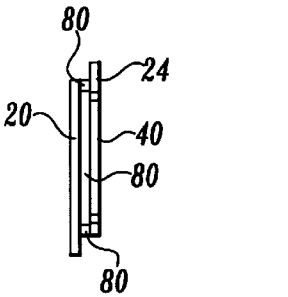
Figure 6C:
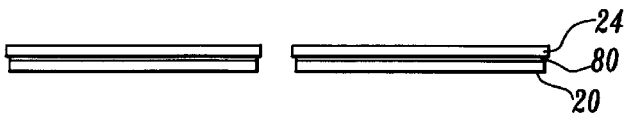

FIGS. 6A, 6B, and 6C are a front view, an end view, and a top plan view, respectively, which illustrate the coupling of the sliding back board 20 to the mold board 24. For this purpose, the mold board 24 is provided with a pair of flat spacer bars 80 welded across upper and lower edge portions on a forward surface of the mold board 24. The flat spacer bars 80 run along and parallel to the longitudinal length of the mold board, and also vertically therebetween adjacent the opening 40. One flat spacer bar 80 lies on the mold board 24 above the opening 40, and the other flat spacer bar 80 lies below the opening 40 on the mold board 24. As best shown in FIG. 6B, the flat spacer bars 80 project forward from the forward surface of the mold board 24, and provide slide surfaces which reduce total friction between the mold board 24 and the sliding back board 20 when the latter is displaced with respect to the former.

The gap between the two mold boards 24 is filled by a steel plate (not shown), equal in thickness to spacer bars 80, that spans the gap and that is spot welded to one of the mold boards. This plate prevents asphalt mix from entering the center of the main screed, while permitting the mold boards to move relative to each other when the power crown is operated.

Figure 7A:
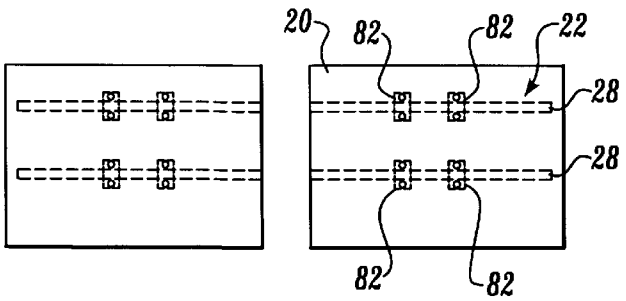
FIGS. 7A, 7B, and 7C are a front view, an end view, and a top plan view, respectively, of the coupling of sliding back boards to support shafts of FIG. 1 in accordance with the present invention.
Figure 7B:
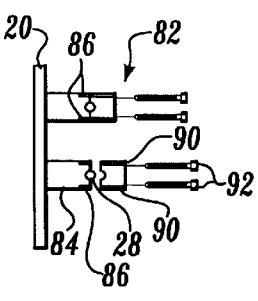
Figure 7C:
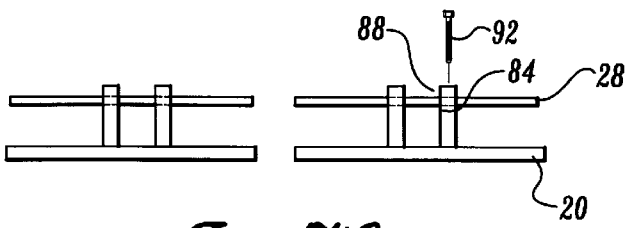

FIGS. 7A, 7B, and 7C are a front view, an end view, and a top plan view, respectively, of the present assembly which illustrate the coupling of the sliding back board 20 to the shafts 28 that are part of the first linear actuator 22. Particularly, four clamp assemblies 82 are welded onto a rear surface of the sliding back board 20 and are used to clamp around the support shafts 28, with two clamp assemblies 82 being used for each shaft 28. The two clamp assemblies 82 are spaced apart along the length of the corresponding shaft 28. Each pair of clamp assemblies 82 is placed in a manner such that it will remain between two support shaft guides 65 irrespective of displacement of the support shaft 28 relative to the mold board 24 (see FIGS. 9A and 9E).

As best shown in FIG. 7B, the clamp assembly 82 includes a shaftmounting clamp 84 welded to the sliding back board 20 and having two threaded apertures 86, a clamp cap 88 having two apertures 90, and two bolts 92. The shaft mounting clamp 84 and the clamp cap 88 both include a trough with a semicircular cross section having a diameter that is roughly the same as that of the support shaft 28. These troughs are configured so that, when the shaft mounting clamp 84 and the clamp cap 88 are assembled, the two troughs form a cylindrical passage for receiving the support shaft 28. Prior to clamping, the shaft 28 is positioned between the troughs of the shaft mounting clamp 84 and the clamp cap 88. The bolt 92 then runs through the aperture 90 of the clamp cap 88 and the threaded aperture 86 of the shaft-mounting clamp 84 to fixedly secure the support shaft 28 to the sliding back board 20.

Figure 8B:
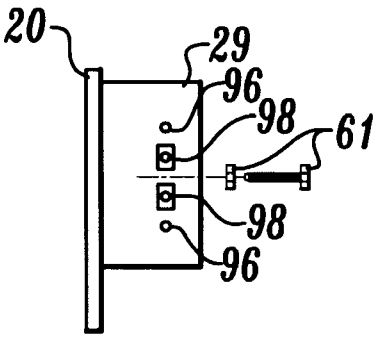
FIGS. 8A and 8B are a front view and an end view, respectively, of the coupling of a sliding back board, an end plate, a hydraulic cylinder assembly, and support shafts of FIG. 1 in accordance with the present invention.
Figure 8A:
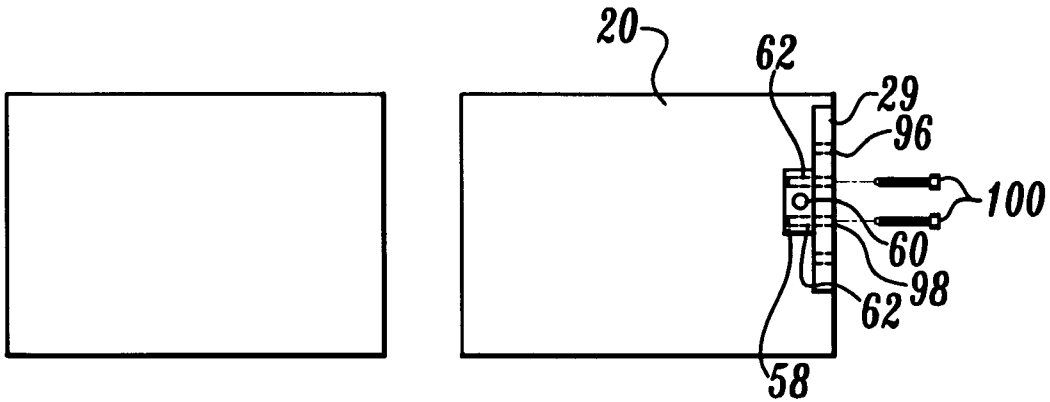

FIGS. 8A and 8B are a front view and an end view, respectively, of the present invention which illustrate the coupling of an end plate 29 to the support shafts 28 and the hydraulic cylinder assembly 26 (26 and 28 are not shown in FIGS. 8A and 8B). The end plate 29 includes a pair of apertures for a support shaft 96 and a pair of apertures for a hydraulic cylinder assembly 98. The bolts 64 described in reference to FIGS. 4A and 4C, run through the end plate 29 via the apertures for support shafts 96 to the threaded apertures 63 provided at the distal ends of the support shafts 28 (see FIG. 5A) to secure the end plate 29 to the support shafts 28. The end plate 29 is attached by a plurality of bolts, or alternately by welding, to the sliding back board 20. Likewise, cylinder attachment bolts 100 run through the end plate 29 via the apertures for a hydraulic cylinder assembly 98 to the threaded apertures 62 provided through the hydraulic cylinder attachment plate 58 to secure the end plate 29 to the hydraulic cylinder assembly 26. With the attachment of the end plate 29 to the support shafts 28 and the hydraulic cylinder assembly 26, as above described, construction of the first linear actuator 22 in accordance with the present invention is complete.

Figure 9C:
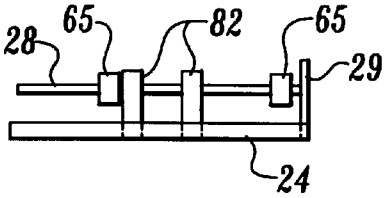
FIGS. 9C and 9D are a top plan view showing only a support shaft, and a top plan view showing only a hydraulic cylinder assembly, respectively, of FIGS. 9A and 9B.
Figure 9D:
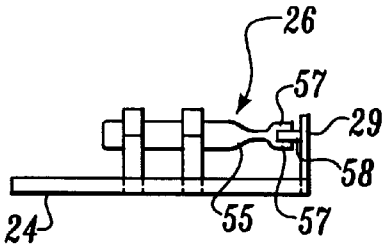
Figure 9B:
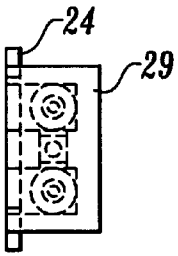
FIGS. 9A and 9B are a schematic front view and a schematic end view, respectively, of the configuration of a first linear actuator and a sliding back board (not shown) of FIG. 1 in accordance with the present invention.
Figure 9F:
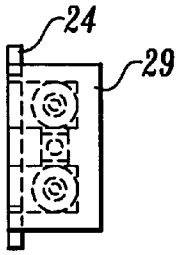
FIGS. 9E and 9F are a schematic front view and a schematic end view, respectively, of the same configuration as FIGS. 9A and 9B when the first linear actuator is fully extended.
Figure 9A:
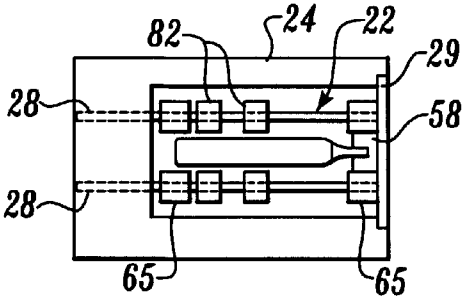
Figure 9E:
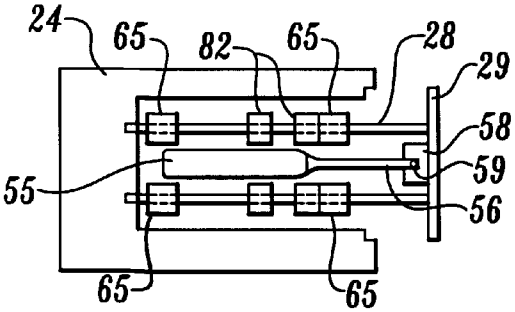

FIGS. 9A and 9B are a front view and an end view, respectively, of the present invention schematically illustrating the interaction between the first linear actuator 22 and the sliding back board 20 (not shown in FIGS. 9A through 9F). FIGS. 9C and 9D are a top plan view showing the support shaft 28 only, and a top plan view showing the hydraulic cylinder assembly 26 only, respectively, of FIGS. 9A and 9B. Further, FIGS. 9E and 9F are a front view and an end view, respectively, of the same configuration when the first linear actuator 22 is fully extended. As previously described, the support shafts 28 of the first linear actuator 22 are coupled to the housing box 38 (not shown) with four support shaft guides 65, and are coupled to the sliding back board 20 (not shown) with four clamp assemblies 82. As best illustrated by comparing FIGS. 9A and 9E, when the first linear actuator 22 is extended, the support shafts 28 and the end plate 29 are displaced with respect to the mold board 24. With the support shafts 28, four clamp assemblies 82 are also displaced with respect to the mold board 24 while remaining between a pair of the support shaft guides 65. With the clamp assemblies 82 and the end plate 29, the sliding back board 20 (not shown) is also displaced with respect to the mold board 24.

Figure 10B:
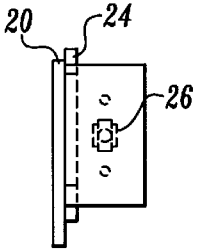
FIGS. 10A and 10B are a front view and an end view, respectively, of the configuration of mold boards and sliding back boards of FIG. 1 in accordance with the present invention.
Figure 10D:
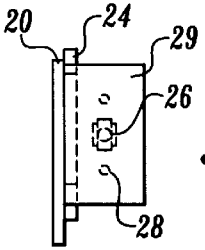
FIGS. 10C, 10D, and 10E are a front view, an end view, and a top plan view, respectively, of the same configuration as FIGS. 10A and 10B when the linear actuators are fully extended.
Figure 10C:
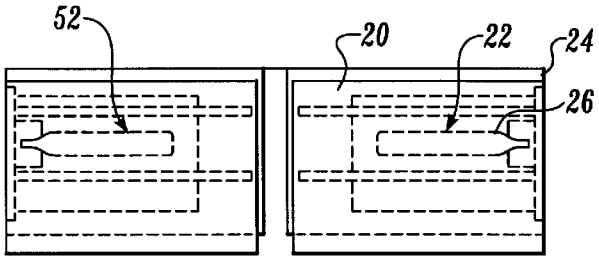
Figure 10E:
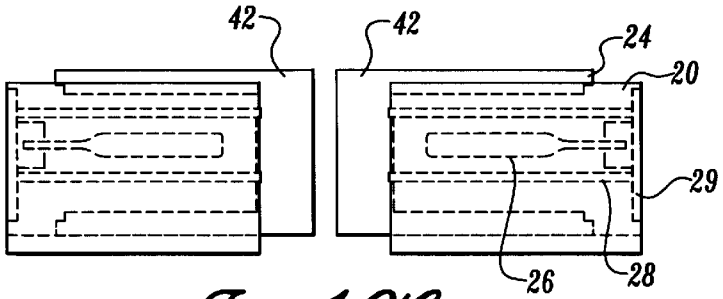
Figure 10F:
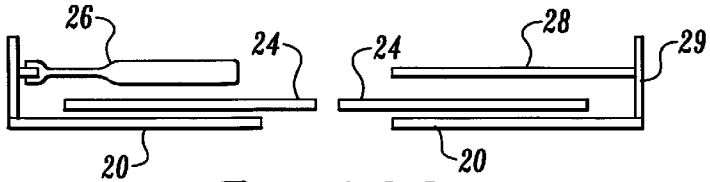

The interaction between the mold boards 24 and the sliding back boards 20 is better illustrated by FIGS. 10A through 10E. FIGS. 10A and 10B are a front schematic view and an end schematic view of the present invention when the first linear actuator 22 and the corresponding third linear actuator 52 are not extended, while FIGS. 10C, 10D, and 10E are a front schematic view, an end schematic view, and a top plan schematic view of the same when the first and third linear actuators 22, 52 are fully extended. As best illustrated in FIG. 10C, it should be noted that the base portions 42 provided on the mold boards 24 serve to prohibit asphalt mix from intruding inside the housing boxes 38 (not shown) when the sliding back boards 20 are fully extended.

Figure 11B:
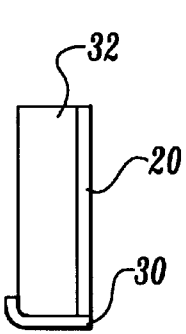
FIGS. 11A, 11B, and 11C are a front view, an end view, and a top plan view, respectively, schematically illustrating extension screed assemblies of FIG. 1 in accordance with the present invention.
Figure 11A:
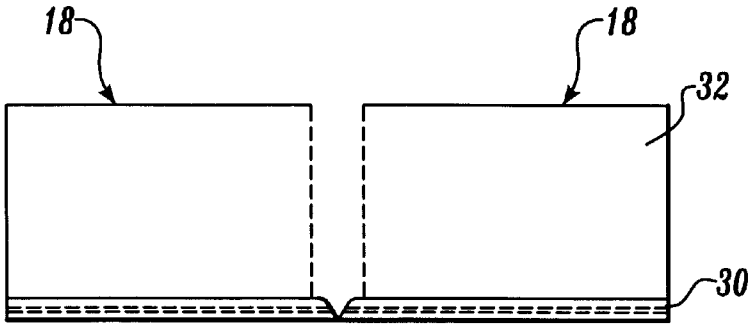
Figure 11C:
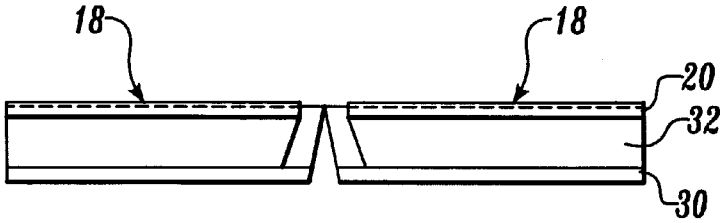

FIGS. 11A, 11B, and 11C are a front view, an end view, and a top plan view, respectively, of the present invention which schematically illustrate first and second extension screed assemblies 18. Each extension screed assembly 18 includes an extension screed 30 and a second linear actuator 32 (not shown in detail) that is coupled to both the extension screed 30 and the sliding back board 20. As best illustrated in FIG. 11C, each extension screed 30 preferably is tapered along the inside edge thereof, around the center of the main screed 12, with the largest longitudinal width of the extension screed 30 being at its rear edge and the least longitudinal width thereof being at its forward edge. This design forces excess asphalt mix forward and thus allows the extension screeds 30 to meet and touch each other at the center of the main screed 12. The second linear actuator 32 typically comprises hydraulic cylinders and support shafts, and is constructed in a conventional manner.

FIGS. 12A through 12D are schematic front views of the screed assembly 10 of the present invention in use. FIG. 12A shows the screed assembly closed, FIG. 12B shows only the sliding back boards 20 fully extended (i.e., first stage extension due to first linear actuator), FIG. 12C shows both the sliding back boards 20 and the extension screeds 30 fully extended (i.e., second stage extension due to second linear actuator), and FIG. 12D shows the sliding back boards 20 closed and only the extension screeds 30 fully extended. FIG. 12E is a schematic end view of FIGS. 12A through 12D. Thus, the total width of the paving screed assembly can be selectively varied between just the width of the main screed (FIG. 12A) to double the width of the main screed (FIG. 12C).

Figure 13A:
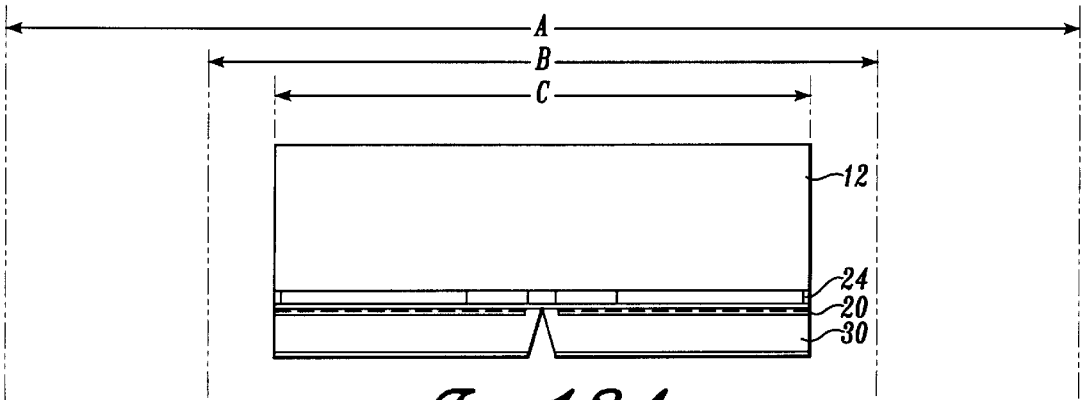
FIGS. 13A through 13D are schematic top plan views of the screed assembly of FIGS. 12A through 12D, respectively.
Figure 13B:
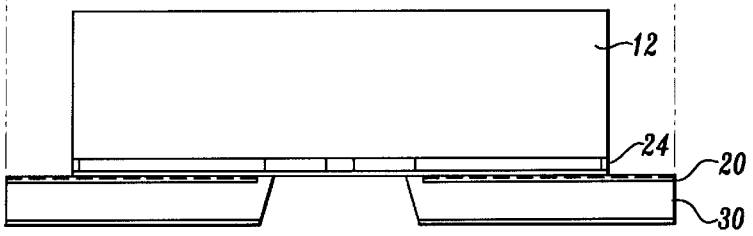
Figure 13C:
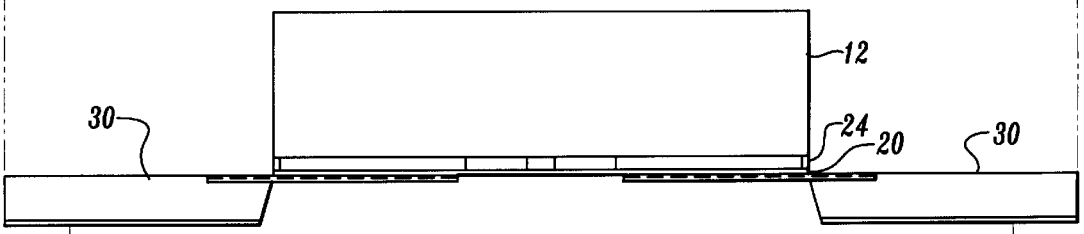
Figure 13D:
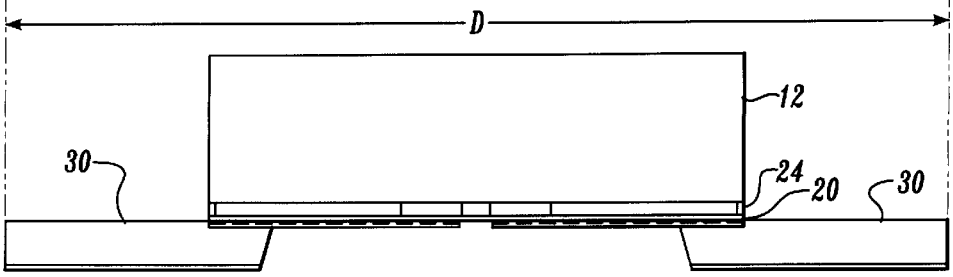

FIGS. 13A through 13D are schematic top plan views of FIGS. 12A through 12D, respectively. Effective paving widths of each arrangement corresponding to FIGS. 13A through 13D are represented as "a", "b", "c", and "d", respectively. FIG. 13D illustrates the present invention with only the extension screeds 30 extended; the width obtained in this configuration is equivalent to the maximum paving width achievable by conventional extension screeds. The present invention as shown in FIG. 13C, on the other hand, successfully doubles an effective paving width of a main screed 12, by further extending the extension screeds 30 through displacement of the sliding back boards 20 relative to the main screed 12. For example, when the present invention is applied to a standard ten-foot main screed, its effective paving width can be variable up to 20 feet. Because the sliding back boards 20 and the extension screeds 30 are each operated by a separate linear actuator, all widths in their respective ranges are independently variable.

Though the linear actuators of the present invention have been described as comprising hydraulic cylinders and pistons, one of ordinary skill in the art can readily substitute linear actuators powered by other means such as air and electricity. Likewise, other types of linear actuators, such as a rack and pinion arrangement, could be utilized. Further, while the extension screeds of the present invention are preferably mounted on the front of a main screed, they could alternatively be mounted on the back of a main screed.

While the foregoing screed assembly has been described as an assembly which includes a main screed and an extension screed assembly, it should be apparent to one of ordinary skill in the art that the present invention can be readily adapted for use with a conventional main screed, or a conventional main screed with a conventional extension screed assembly. These adaptations merely require providing only the extension screed assembly in the former case, or only the sliding back board assembly in the latter case, of the present invention.

While the preferred embodiments of the invention have been illustrated and described, it will be appreciated that various changes can be made therein without departing from the spirit and scope of the invention.

What is claimed is:

1. An extension screed assembly for use with a paving machine, comprising:

an elongate main screed assembly defining a length and a front side facing the paving machine;

a first sliding back board mounted on the front side of the main screed assembly;

a first linear actuator coupled to the main screed assembly and the first sliding back board, which displaces the first sliding back board relative to and on the front side of the main screed assembly longitudinally along the length of the main screed assembly;

a first extension screed; and a second linear actuator coupling the first extension screed to the first sliding back board, which displaces the first extension screed relative to the first sliding back board longitudinally along the length of and on the front side of the main screed assembly.

2. The extension screed assembly of claim 1, wherein the linear actuators comprise hydraulic cylinders and pistons.

3. The extension screed assembly of claim 1, wherein the first linear actuator is coupled to a mold board housing of the main screed assembly.

4. The extension screed assembly of claim 1, further comprising:

a second sliding back board mounted on the front side of the main screed assembly adjacent the first sliding back board along the length of the main screed assembly;

a third linear actuator coupled to the main screed assembly and the second sliding back board, which displaces the second sliding back board relative to and along the front side of the main screed assembly along the length of the main screed assembly;

a second extension screed mounted on the second sliding back board; and a fourth linear actuator coupled to the second sliding back board and the second extension screed, which displaces the second extension screed relative to the second sliding back board along the length of and on the front side of the main screed assembly.

5. The extension screed assembly of claim 4, wherein the first extension screed and the second extension screed are aligned and parallel to a longitudinal axis of the main screed assembly.

6. The extension screed assembly of claim 5, wherein the first extension screed and the second extension screed, when fully extended, double an effective paving width of the main screed assembly.

7. An extension screed assembly for use with a paving machine, comprising:

an elongate main screed assembly defining a length and a front side facing the paving machine;

a first sliding back board mounted on the front side of the main screed assembly;

a first linear actuator coupled to the front side of the main screed assembly, the first linear actuator being further coupled to the first sliding back board and adapted to displace the first sliding back board relative to and on the front side of the main screed assembly longitudinally along the length of the main screed assembly;

a first extension screed; and a second linear actuator coupled to the front side of the first sliding backboard, the second linear actuator being further coupled to the first extension screed and adapted to displace the first extension screed relative to the first sliding back board longitudinally along the length of and on the front side of the main screed assembly.

8. The extension screed assembly of claim 7, wherein the linear actuators comprise hydraulic cylinders and pistons.

9. An extension screed assembly for use with a paving machine, comprising:

an elongate main screed assembly defining a length and a front side facing the paving machine;

a first sliding back board mounted on the front side of the main screed assembly;

a first linear actuator coupled to the main screed assembly and the first sliding back board, which displaces the first sliding back board relative to and on the front side of the main screed assembly longitudinally along the length of the main screed assembly;

a first extension screed mounted on the first sliding back board;

a second linear actuator coupled to the first sliding back board and the first extension screed, which displaces the first extension screed relative to the first sliding back board longitudinally along the length of and on the front side of the main screed assembly;

a second sliding back board mounted on the front side of the main screed assembly adjacent the first sliding back board along the length of the main screed assembly;

a third linear actuator coupled to the main screed assembly and the second sliding back board, which displaces the second sliding back board relative to and on the front side of the main screed assembly longitudinally along the length of the main screed assembly;

a second extension screed mounted on the second sliding back board; and a fourth linear actuator coupled to the second sliding back board and the second extension screed, which displaces the second extension screed relative to the second sliding back board longitudinally along the length of and on the front side of the main screed assembly.

10. The extension screed assembly of claim 9, wherein the first extension screed and the second extension screed, when fully extended, double an effective paving width of the main screed assembly.

11. An extension screed assembly for use with a paving machine, comprising:

an elongate main screed assembly defining a length and a front side facing the paving machine;

a first sliding back board mounted on the front side of the main screed assembly;

a first linear actuator coupled to the main screed assembly and the first sliding back board, which displaces the first sliding back board relative to the main screed assembly longitudinally the length of and on the front side of the main screed assembly;

a first extension screed mounted on the first sliding back board;

a second linear actuator coupled to the first sliding back board and the first extension screed, which displaces the first extension screed relative to the first sliding back board longitudinally along the length of and on the front side of the main screed assembly;

a second sliding back board mounted on the front side of the main screed assembly adjacent the first sliding back board along the length of the main screed assembly;

a third linear actuator coupled to the main screed assembly and the second sliding back board, which displaces the second sliding back board relative to the main screed assembly longitudinally along the length of and on the front side of the main screed assembly;

a second extension screed mounted on the second sliding back board; and a fourth linear actuator coupled to the second sliding back board and the second extension screed, which displaces the second extension screed relative to the second sliding back board longitudinally along the length of and on the front side of the main screed assembly;

wherein a rear side of the first extension screed and a rear side of the second extension screed are separated from the front side of the main screed assembly by an equal distance.

12. An extension screed assembly for mounting on an elongate main screed assembly defining a length and a front side facing a paving machine, comprising:

a first sliding back board;

a first linear actuator coupled to the first sliding back board, the first linear actuator being adapted to be mounted on the front side of the main screed assembly to displace the first sliding back board relative to the main screed assembly longitudinally along the length of and on the front side of the main screed assembly;

a first extension screed mounted on the first sliding back board; and a second linear actuator coupled to the first sliding back board and the first extension screed, the second linear actuator being adapted to be mounted on the front side of the main screed assembly to displace the first extension screed relative to the first sliding back board longdinally along the length of and on the front side of the main screed assembly.

13. The extension screed assembly of claim 12, wherein the linear actuators comprise hydraulic cylinders and pistons.

14. The extension screed assembly of claim 12, further comprising:

a second sliding back board adjacent the first sliding back board;

a third linear actuator coupled to the second sliding back board, the third linear actuator being adapted to be mounted on the front side of the main screed assembly to displace the second sliding back board relative to the main screed assembly along the length of and on the front side of the main screed assembly;

a second extension screed mounted on the second sliding back board; and a fourth linear actuator coupled to the second sliding back board and the second extension screed, the fourth linear actuator being adapted to be mounted on the front side of the main screed assembly to displace the second extension screed relative to the second sliding back board along the length of and on the front side of the main screed assembly;

wherein the first extension screed and the second extension screed are adapted to be mounted on the front side of the main screed assembly to be aligned and parallel to a longitudinal axis of the main screed assembly.

15. The extension screed assembly of claim 14, wherein the first extension screed and the second extension screed are adapted to be mounted on the main screed assembly to double an effective paving width of the main screed assembly when the first and second extension screeds are fully extended.

* * * * *

UNITED STATES PATENT AND TRADEMARK OFFICE

CERTIFICATE OF CORRECTION

PATENT NO. : 6,203,243 B1
DATED : March 20, 2001
INVENTOR(S) : R. D. Birtchet

It is certified that error appears in the above-identified patent and that said Letters Patent is hereby corrected as shown below:

Column 1,
Assignee, "Centrailia," should read -- Centralia, --

Column 12,
Line 29, "longdinally," should read -- longitudinally --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*